US006202420B1

(12) United States Patent
Zarzalis et al.

(10) Patent No.: US 6,202,420 B1
(45) Date of Patent: Mar. 20, 2001

(54) TANGENTIALLY ALIGNED PRE-MIXING COMBUSTION CHAMBER FOR A GAS TURBINE

(75) Inventors: Nikoloas Zarzalis, Dachau; Thomas Ripplinger, Vierkirchen, both of (DE)

(73) Assignee: MTU Motoren-und Turbinen-Union München GmbH, München (DE)

( * ) Notice: Subject to any disclaimer, the term of this patent is extended or adjusted under 35 U.S.C. 154(b) by 0 days.

(21) Appl. No.: 09/211,837

(22) Filed: Dec. 15, 1998

(30) Foreign Application Priority Data

Dec. 19, 1997 (DE) ..... 197 56 663
Mar. 12, 1998 (DE) ..... 198 10 648

(51) Int. Cl.[7] ..... F23R 3/30
(52) U.S. Cl. ..... 60/737; 60/746
(58) Field of Search ..... 60/737, 746, 747, 60/39.36, 39.37

(56) References Cited

U.S. PATENT DOCUMENTS 3,872,664 * 3/1975 Lohmann et al. ..... 60/746
3,958,416 5/1976 Hammond, Jr. et al. .
4,204,402 * 5/1980 Craig et al. ..... 60/746 X
4,498,288 * 2/1985 Vogt ..... 60/747 X
4,805,411 * 2/1989 Hellat et al. ..... 60/737 X
4,955,191 * 9/1990 Okamoto et al. ..... 60/746 X
5,319,935 6/1994 Toon et al. .
5,473,881 12/1995 Kramnik et al. .
5,687,571 * 11/1997 Althaus et al. ..... 60/737
5,802,854 * 9/1998 Maeda et al. ..... 60/737

FOREIGN PATENT DOCUMENTS 43 18 405 2/1995 (DE) .

* cited by examiner

*Primary Examiner*—Ted Kim
(74) *Attorney, Agent, or Firm*—Schiff Hardin & Waite

(57) ABSTRACT

A pre-mixing combustion chamber (8) for a gas turbine is disclosed which includes a main stage with at least one pre-mixing chamber and a combustion chamber fashioned at least partly dynamically balanced relative to its longitudinal axis with a main combustion zone (3) and an after-combustion zone (5) placed downstream, whereby the at least one pre-mixing chamber discharges into the combustion chamber in the region of the main combustion zone tangentially producing twisting action. The pre-mixing chamber also includes a pilot stage (4) with a pilot injection means, whereby the main combustion zone in the combustion chamber proceeds essentially coaxial to the after-combustion zone, and the pilot stage is arranged at that end of the combustion chamber remote from the after-combustion zone.

19 Claims, 4 Drawing Sheets

TANGENTIALLY ALIGNED PRE-MIXING COMBUSTION CHAMBER FOR A GAS TURBINE

FIELD OF THE INVENTION

The present invention is directed to gas turbines. More specifically, the present invention relates to a pre-mixing combustion chamber for a gas turbine. The present invention also relates to annular combustion chambers equipped with a plurality of pre-mixing combustion chambers.

BACKGROUND OF THE INVENTION

Pre-mixing combustion chambers are low-pollutant gas turbine combustion chambers. Gas turbines can be utilized both stationary mechanisms such as generator drives in power plants, as well as in aircraft engines. Maximum limits for nitrogen oxide emission of stationary gas turbines have been set in numerous industrialized countries. Since corresponding recommendations also exist for aircraft engines, great significance is accorded to the reduction of nitrogen oxide formation in the combustion chambers in the framework of reducing pollutant emissions. Rich/lean combustion ratios wherein the combustion ensues with a first, rich stage and a second, lean stage with air excess is currently utilized for reducing nitrogen oxide in aircraft engines.

Compared thereto, even greater reductions can be achieved with the pre-mixed lean combustion applied in stationary gas turbines. Since the nitrogen oxide formation increases with, among other things, the highest temperature, methods have been developed to lower the highest flame temperature. A distinction is thereby made between wet and dry methods. In the previously predominantly employed, wet methods, water or water vapor are introduced into the combustion zone separately or pre-mixed with the fuel. It is thereby disadvantageous that processed water is required, the consumption thereof also being high. Over and above this, the system efficiency drops given the wet methods.

Due to these disadvantages, dry methods wherein the excess air coefficient in the combustion zone is increased as far as possible and air and fuel are entirely or partially pre-mixed are increasingly desired. In order to meet the legal regulations and recommendations, air and fuel must be mixed as uniformly as possible preceding the combustion chamber. The peak temperatures in the flame can be reduced in this way by itself. To this end, pre-mixing combustion chambers have been developed wherein a specific length of the pre-mixing chamber or a minimum dwell time in the pre-mixing chamber is needed in order to achieve a high degree of homogeneity. However, there is thereby the risk that the fuel/air mixture will ignite in the pre-mixing chamber. Since the blending process is not completed in this case, high temperatures that lead to increased nitrogen oxide formation arise locally as a consequence of inhomogeneities. Further, there is the risk of a flashback from the combustion zone into the pre-mixing chamber. In order to avoid this, paddle grids or the like are attached at the end of the pre-mixing chamber given traditional pre-mixing chambers in order to accelerate the mixture and produce a twist. When a flashback nonetheless occurs, this leads to damage or destruction of combustion chamber parts such as, for example, the paddle grid.

In a known combustion chamber arrangement according to German Letters Patent 43 18 405, a reduction of the nitrogen oxide formation is enabled with pre-mixed lean combustion without risk of self-ignition in a pre-mixing path in that the fuel is injected into a pre-mixing chamber fashioned essentially straight that tangentially discharges into an essentially rotationally-symmetrically fashioned combustion chamber, as a result whereof a creation of twist is achieved when the mixture flows in. Since the twisting is not generated with additional component parts such as paddle grids, the risk of parts damage given a potentially occurring flashback is eliminated. An adequate combustion stability is assured with a supporting pilot combustion that ensues in a separate combustion zone. The hot gasses from the pilot zone are mixed into the lean main zone, whereby the stabilizing effect is highly dependent on the existing flow field and can be subject to greater fluctuations in different operating conditions. Moreover, the flow from the main combustion zone into the after-combustion zone is deflected by 90°, which leads to an increased pressure loss.

Therefore, there is a need for a pre-mixing combustion chamber of the species initially described wherein the stabilizing effect of the pilot combustion is improved.

SUMMARY OF THE INVENTION

The inventive solution is characterized in that the main combustion zone in the combustion chamber proceeds or, respectively, is arranged essentially coaxially or, respectively, parallel to the after-combustion zone. i.e. the flow path is essentially straight and proceeds without significant deflection, and the pilot stage is arranged at that end of the combustion chamber remote from the after-combustion zone.

The advantage of this pre-mixing chamber is comprised therein that the flow within the combustion chamber from the main combustion zone to the after-combustion zone is not deflected by 90° and the pressure loss connected therewith is eliminated. Due to the pilot stage arranged directly at the combustion chamber, this has a direct connection to the main combustion or, respectively, recirculation zone, as a result whereof the stabilizing effect of the pilot combustion is noticeably improved. The inventive pre-mixing combustion chamber can be utilized both in stationary gas turbines as well as in aircraft engines.

In a preferred embodiment of the invention, the region of the combustion chamber forming the main combustion zone expands conically in flow direction, which proceeds from the main combustion zone in the direction toward the after-combustion zone. The recirculation zone and, thus, the flame stability can be controlled by the aperture angle of the cone. Whereas an additional pre-evaporation region derives given smaller aperture angles, the stability of the combustion is promoted given larger aperture angles.

The pilot stage is preferably arranged at the end of the combustion chamber with smaller radius at the end face and proceeds coaxially thereto.

It can be expedient that the pilot stage comprises a pilot combustion chamber arranged between the pilot injection device and the combustion chamber.

In an embodiment, the present invention comprises a pre-mixing combustion chamber assembly for a gas turbine. The pre-mixing combustion chamber assembly comprises a first main stage housing comprising an inlet end and a discharge end and further defining a first pre-mixing chamber disposed therebetween. the discharge end of the first main stage housing is connected to a combustion chamber. The combustion chamber comprises a pilot end and an outlet end. The combustion chamber defines a main combustion zone. The outlet end of the combustion chamber is connected to a housing section which defines an after-combustion zone. The combustion chamber and housing section being disposed coaxially with respect to each other. The main combustion zone is disposed longitudinally between the pilot end of the combustion chamber and the after-combustion zone. The discharge end of the first main stage housing provides communication between the first pre-mixing chamber and the main combustion zone. The pilot end of the combustion chamber is connected to a pilot stage comprising a pilot injection mechanism.

In an embodiment, the first pre-mixing chamber is a rectangular channel.

In an embodiment, the combustion chamber has a longitudinal axis and the first pre-mixing chamber is a rectangular channel having a height extending perpendicular to the longitudinal axis of the combustion chamber and a width extending tangentially to the combustion chamber. The width being greater than the height.

In an embodiment, the combustion chamber is conically shaped with a longitudinal axis and a maximum eccentricity. The discharge end of the first pre-mixing chamber is disposed along the maximum eccentricity of the combustion chamber.

In an embodiment, the present invention further comprises a second main stage housing comprising an inlet end and a discharge end and defining a second pre-mixing chamber disposed therebetween. The discharge end of the second main stage housing is connected to the combustion chamber at a diametrically opposed position with respect to the discharge end of the first main stage housing. The discharge end of the second main stage housing providing communication between the second pre-mixing chamber and the main combustion zone.

In an embodiment, the present invention further comprises a third main stage housing and fourth main stage housing similar or identical to the first and second main stage housings described above and which are attached to the combustion chamber at diametrically opposed positions and between the first and second main stage housings.

In an embodiment, the combustion chamber is conically shaped and widens as the combustion chamber extends from the pilot end to the outlet end.

In an embodiment, the pilot stage is coaxial with respect to the combustion chamber.

In an embodiment, the pilot stage comprises a pilot combustion chamber and a pilot injection mechanism. The pilot combustion chamber is disposed between the pilot injection mechanism and the combustion chamber.

In an embodiment, the housing section forms an annular combustion chamber. The annular combustion chamber is connected to a plurality of like combustion chambers spaced equidistantly around the annular combustion chamber.

In an embodiment, the housing section is cylindrical and is connected to an annular combustion chamber. The annular combustion chamber is connected to a plurality of like housing sections of like pre-mixing combustion chambers spaced equidistantly around the annular combustion chamber.

Other objects and advantages of the invention will become apparent upon reading the following detailed description and appended claims, and upon reference to the accompanying drawings.

BRIEF DESCRIPTION OF THE DRAWING

The invention is explained in greater detail below on the basis of exemplary embodiments with reference to a drawing, wherein.

Figure 1:
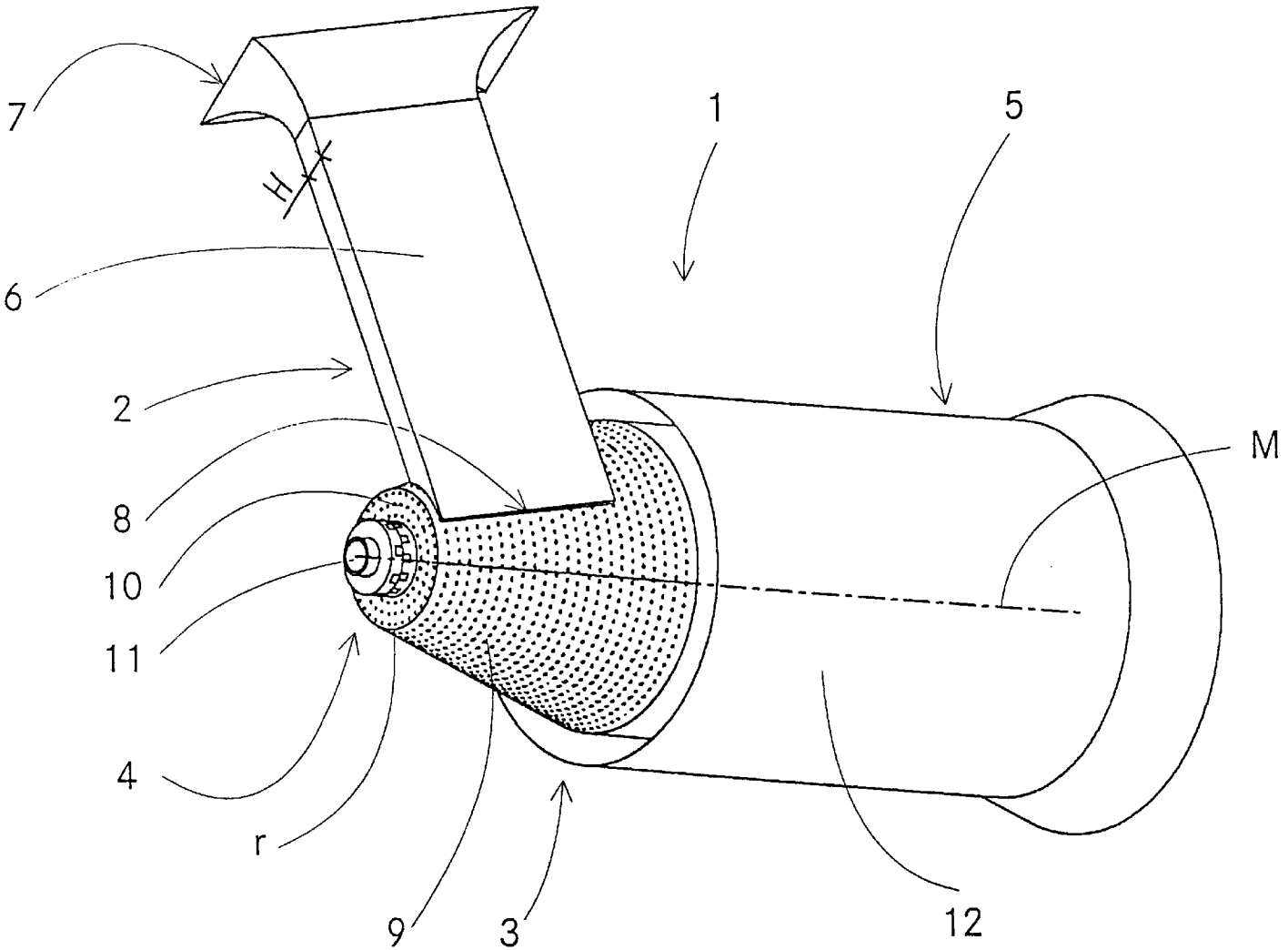
FIG. 1 is a perspective schematic view of an exemplary embodiment of the inventive pre-mixing combustion chamber that is limited to the critical component parts.

It should be understood that the drawing is not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

FIG. 1 shows an exemplary embodiment of a pre-mixing combustion chamber (referenced 1 overall) for a gas turbine. The pre-mixing combustion chamber 1 essentially comprises a main stage housing 2 with a pre-mixing chamber 6, a main combustion zone 3 and an after-combustion zone 5 as well as a pilot stage 4. The fuel together with a part of the compressor air is introduced at an inlet 7 of the pre-mixing chamber 6. The fuel is atomized in the pre-mixing chamber 6, evaporated and optimally homogeneously mixed with the air. The pre-mixing chamber 6 is fashioned as a straightline, rectangular channel, so that a twist-free flow with a comparatively uniform velocity profile is generated within the pre-mixing chamber 6. This leads to a high blend homogeneity between the fuel and the air, as a result whereof temperature spikes with an increased nitrogen oxide formation are avoided. Dependent on the machine design, the pre-mixing chamber 6 can also exhibit other suitable crossectional shapes such as, for example, oval or circular as well. The crossectional shape also need not necessarily be constant over the length of the pre-mixing chamber 6.

At a discharge end 8 of the pre-mixing chamber 6, the fuel-air mixture flows into the combustion chamber 9, which comprises a part fashioned as conic frustum lying in the region of the main combustion zone 3 and a cylindrical part 12 lying in the region of the after-combustion zone 5. The flow is thereby introduced with an optimally great eccentricity relative to a longitudinal or, respectively, center axis M of the dynamically balanced combustion chamber 9, so that a circumferential velocity is impressed on the flow of the fuel/air mixture therein. For achieving a greatest possible eccentricity, moreover, the crossectionally rectangular pre-mixing chamber 6 is fashioned with an optimally slight height H. As a result of the twisting, a pronounced recirculation of the fuel-air mixture derives extending from the part of the combustion chamber 9 fashioned as a conic frustum, as a result whereof this flows back into the main combustion zone 3 or, respectively, the conically fashioned part of the combustion chamber 9 and stabilizes the combustion. Only thereafter does the flow proceed into the downstream after-combustion zone 5 that proceeds essentially parallel or, respectively, coaxial to the main combustion zone 3 and, in particular, to the center axis m of the partly conical frustum-shaped combustion chamber 9. The flow path for the fuel-air mixture is thus essentially straight. The combustion chamber 9 comprises a plurality of air admission openings for cooling.

The pilot stage 4 is arranged at an end 10 of the combustion chamber 9 remote from the after-combustion zone 5. In the present embodiment, the pilot stage 4 is also arranged at the face end 10 with the smallest radius of that part of the combustion chamber 9 fashioned as conic frustum. The pilot stage 4 comprises a pilot injection mechanism 11 with which fuel can be introduced into the main combustion zone 3 for stabilizing the combustion, particularly in the partial load range. The hot gasses from the pilot stage 4 flow directly into the core of the recirculation zone of the lean main stage 2, which leads to an improved stability of the combustion. Gaseous and liquid fuels can be utilized both in the main as well as in the pilot stage 2 or, respectively, 4.

Figure 2:
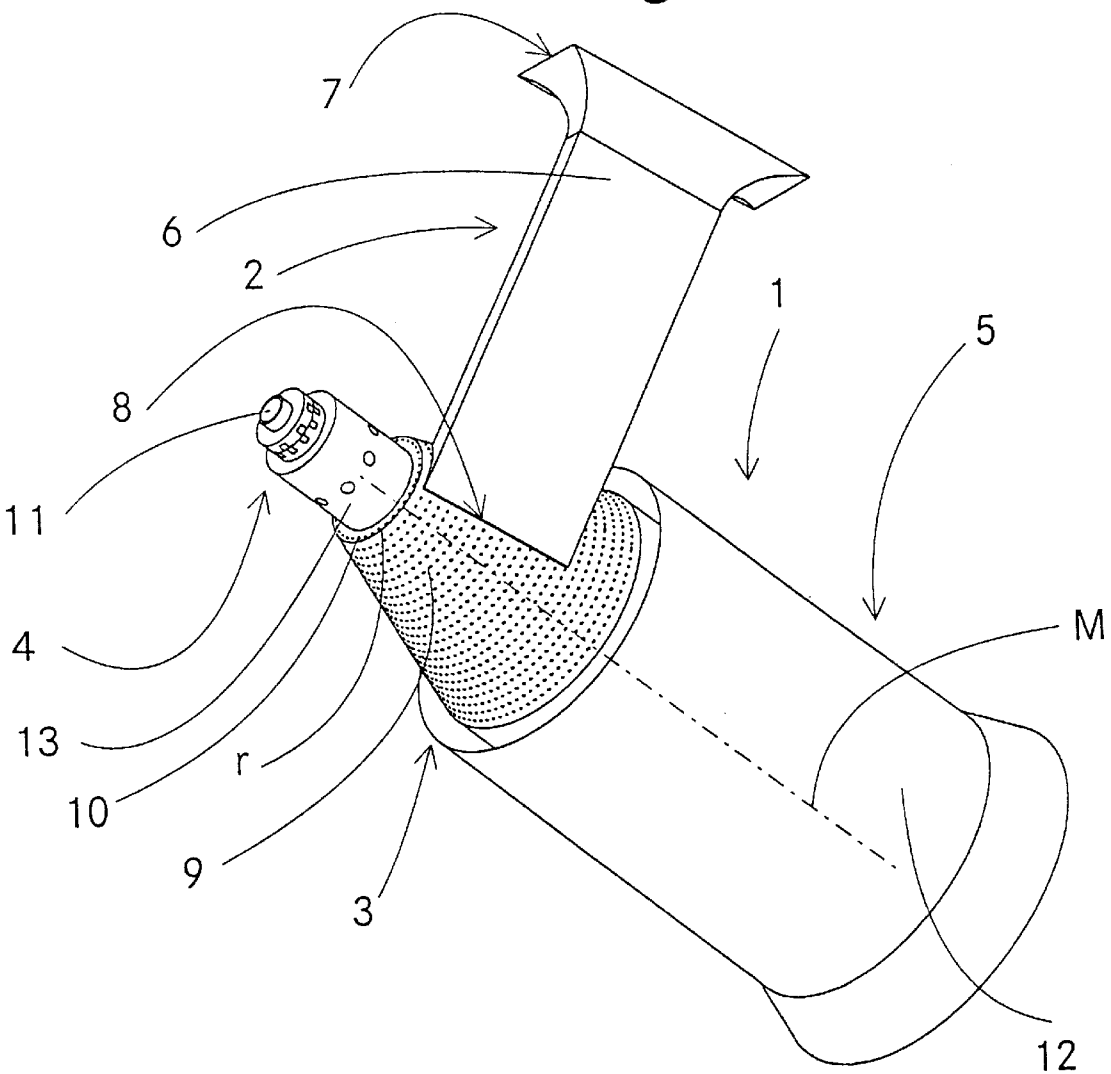
FIG. 2 is a perspective schematic view of a further exemplary embodiment of the inventive pre-mixing combustion chamber.

FIG. 2 shows another exemplary embodiment of the pre-mixing combustion chamber 1 whose modification lies in the region of the pilot stage 4. In FIG. 2, the pilot stage 4—in addition to comprising the pilot injection mechanism 11—comprises a pilot combustion chamber 13 in which the fuel is first mixed with air in a diffusion combustion and is introduced into the combustion chamber 9 at the end face thereafter.

Figure 3:
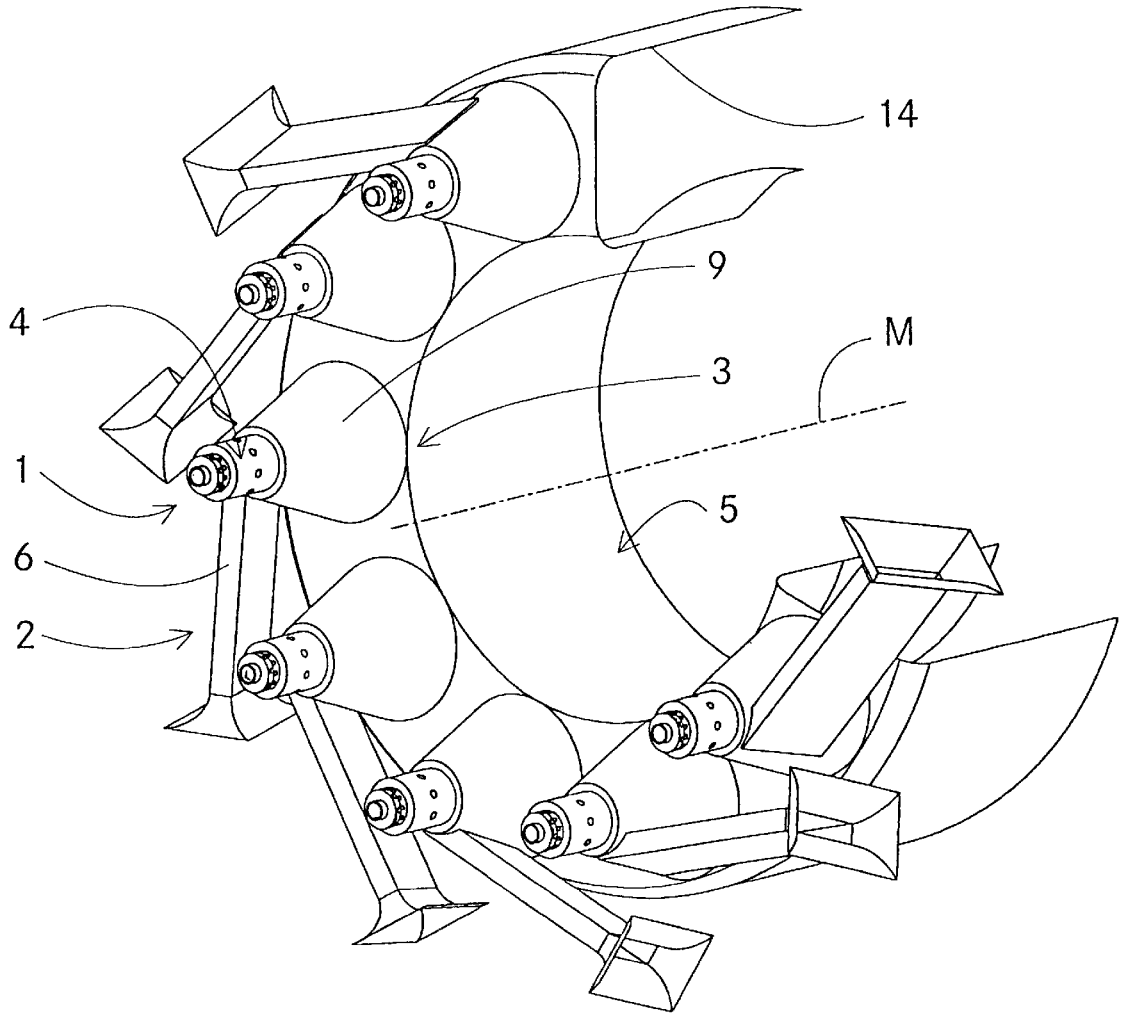
FIG. 3 is a perspective sectional view of an annular combustion chamber arrangement made in accordance with the present invention.
Figure 4:
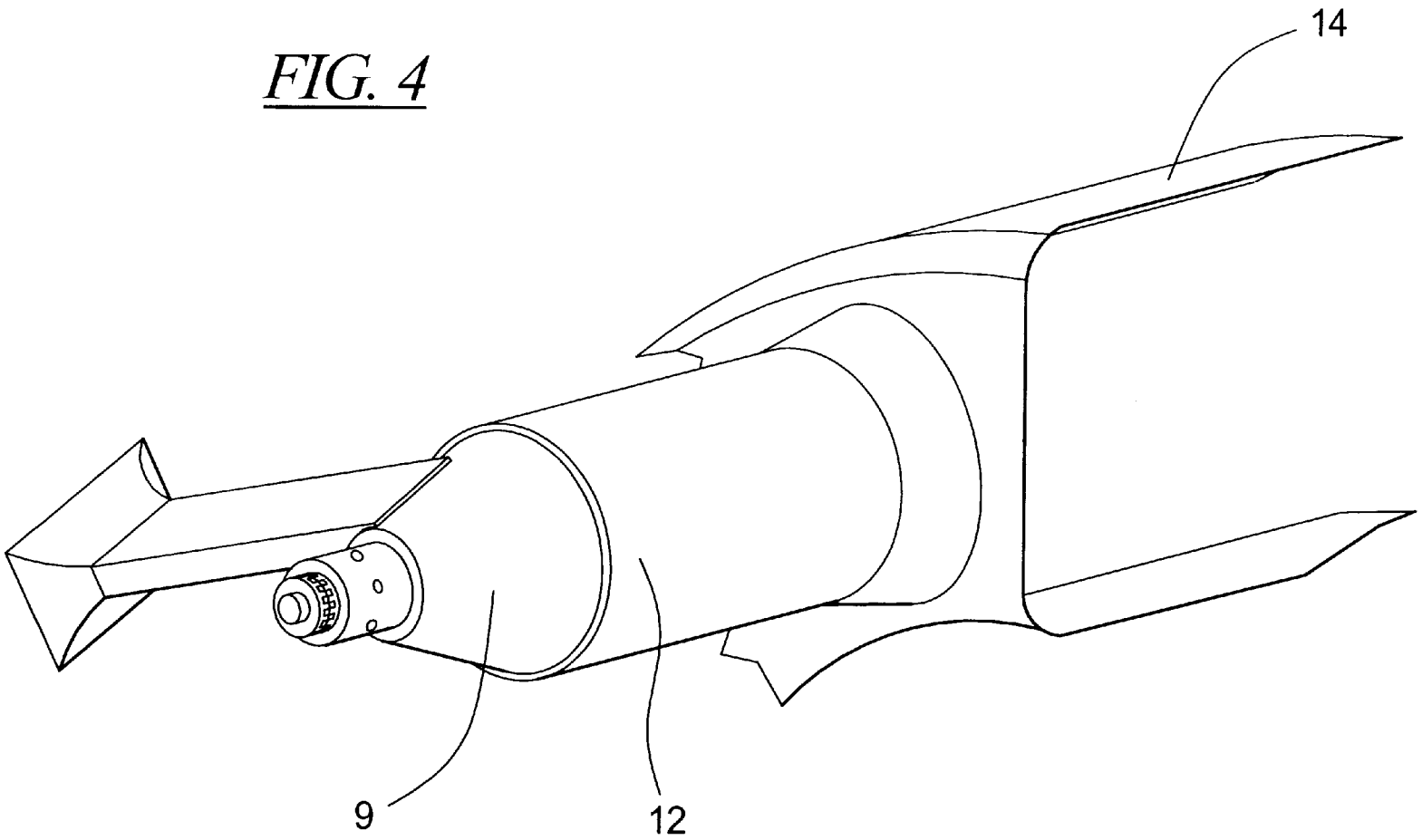
FIG. 4 is a perspective fragmentary view of an alternate embodiment of FIG. 3 wherein a cylindrical part is also provided.

FIG. 3 shows an arrangement wherein a plurality of pre-mixing combustion chambers 1 are combined an annular combustion chamber 14. Here, too, the individual pre-mixing combustion chambers 1 comprise a pre-mixing chamber 6 that discharges eccentrically into a part of the combustion chamber 9 of a main stage housing 2 fashioned as a conic frustum, as well as an after-combustion zone 5 arranged essentially coaxial to the main stage housing 2, as a result whereof the flow between the main combustion zone 3 and the after-combustion 5 does not have to be deflected and the loss of combustion chamber pressure is also reduced. The combustion chamber 9 here could also comprise, shown in FIG. 4 a cylindrical part 12 between the conical part of the combustion chamber 6 and the annular combustion chamber 14, this cylindrical part 12 being arranged essentially coaxial to the longitudinal axis M of the combustion chamber 9. Given installation of the annular combustion chamber 14 into a gas turbine, this has its center axis M arranged coaxial thereto and is charged with air at the injection side by an upstream compressor. The pre-mixing combustion chambers 1 are arranged equidistantly around the end-face circumference of the annular combustion chamber 14. Here, too, the wall of the combustion chamber 9 is provided with air admission openings for cooling.

During operation of the pre-mixing combustion chamber 1, the main stage 2 and the pilot stage 4 can optionally be operated separately or simultaneously dependent on load or, respectively, flight phase.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A pre-mixing combustion chamber assembly for a gas turbine, comprising:

a first main stage housing comprising an inlet end and a discharge end and defining a first pre-mixing chamber disposed therebetween, the discharge end of the first main stage housing being connected to a combustion chamber which is conically shaped and widens as the combustion chamber widens from a pilot end to an outlet end, the combustion chamber having a longitudinal axis and the first pre-mixing chamber having an outer surface whose longitudinal extent meets an outer surface of the conically-shaped combustion chamber substantially tangentially;

the combustion chamber defining a main combustion zone, the outlet end of the combustion chamber being connected to a housing section defining an after-combustion zone, the combustion chamber and the housing section being disposed coaxially with respect to each other, the main combustion zone being disposed longitudinally between the pilot end of the combustion chamber and the after-combustion zone, the discharge end of the first main stage housing providing communication between the first pre-mixing chamber and the main combustion zone; and the pilot end of the combustion chamber being connected to a pilot stage comprising a pilot injection mechanism.

2. The pre-mixing combustion chamber assembly of claim 1 wherein the first pre-mixing chamber is a rectangular channel.

3. The pre-mixing combustion chamber assembly of claim 1 wherein the combustion chamber has a longitudinal axis and the first pre-mixing chamber is a rectangular channel having a height extending perpendicular to the longitudinal axis of the combustion chamber and a width of the pre-mixing chamber extends tangentially to the combustion chamber, the width of the pre-mixing chamber being greater than the height.

4. The pre-mixing combustion chamber assembly of claim 1 wherein the combustion chamber is conically shaped with a longitudinal axis and a maximum eccentricity, and the discharge end of the first pre-mixing chamber is disposed along the maximum eccentricity of the combustion chamber.

5. The pre-mixing combustion chamber assembly of claim 1 further comprising a second main stage housing comprising an inlet end and a discharge end and defining a second pre-mixing chamber disposed therebetween, the discharge end of the second main stage housing being connected to a combustion chamber at a diametrically opposed position with respect to the discharge end of the first main stage housing, the discharge end of the second main stage housing providing communication between the second pre-mixing chamber and the main combustion zone.

6. The pre-mixing combustion chamber assembly of claim 5 further comprising a third main stage housing comprising an inlet end and a discharge end and defining a third pre-mixing chamber disposed therebetween, the discharge end of the third main stage housing providing communication between the third pre-mixing chamber and the main combustion zone, a fourth main stage housing comprising an inlet end and a discharge end and defining a fourth pre-mixing chamber disposed therebetween, the discharge end of the fourth main stage housing providing communication between the fourth pre-mixing chamber and the main combustion zone, and the discharge end of the third main stage housing being connected to a combustion chamber at a diametrically opposed position with respect to the discharge end of the fourth main stage housing, the discharge end of the third main stage housing being disposed between the discharge ends of the first and second main stage housings.

7. The pre-mixing combustion chamber assembly of claim 1 wherein the pilot stage is coaxial with respect to the combustion chamber.

8. The pre-mixing combustion chamber assembly of claim 1 wherein the pilot stage comprises a pilot combustion chamber and a pilot injection mechanism, the pilot combustion chamber being disposed between the pilot injection mechanism and the combustion chamber.

9. The pre-mixing combustion chamber assembly of claim 1 wherein the housing section forms an annular combustion chamber, the annular combustion chamber being connected to a plurality of combustion chambers spaced equidistantly around the annular combustion chamber.

10. The pre-mixing combustion chamber assembly of claim 1 wherein the housing section is cylindrical and is connected to an annular combustion chamber, the annular combustion chamber being connected to a plurality of like housing sections of like pre-mixing combustion chambers spaced equidistantly around the annular combustion chamber.

11. A pre-mixing combustion chamber assembly for a gas turbine, the pre-mixing chamber assembly comprising:

a first main stage housing comprising an inlet end and a discharge end and defining a first pre-mixing chamber disposed therebetween, the discharge end of the first main stage housing being connected to a conical combustion chamber, the combustion chamber comprising a narrow pilot end and a wider outlet end, the combustion chamber defining a main combustion zone, the outlet end of the combustion chamber being connected to a housing section defining an after-combustion zone, the combustion chamber and housing section being disposed coaxially with respect to each other, the discharge end of the first main stage housing providing communication between the first pre-mixing chamber and the combustion chamber, which is conically shaped and widens as the combustion chamber widens from a pilot end to an outlet end, the combustion chamber having a longitudinal axis and the first pre-mixing chamber having an outer surface whose longitudinal extent meets an outer surface of the conically-shaped combustion chamber substantially tangentially; and the pilot end of the combustion chamber being connected to a pilot stage comprising a pilot injection mechanism.

12. The pre-mixing combustion chamber assembly of claim 11 wherein the first pre-mixing chamber is a rectangular channel.

13. The pre-mixing combustion chamber assembly of claim 11 wherein the combustion chamber has a longitudinal axis and a maximum eccentricity, and the discharge end of the first pre-mixing chamber is disposed along the maximum eccentricity of the combustion chamber.

14. The pre-mixing combustion chamber assembly of claim 11 further comprising a second main stage housing comprising an inlet end and a discharge end and defining a second pre-mixing chamber disposed therebetween, the discharge end of the second main stage housing being connected to a combustion chamber at a diametrically opposed position with respect to the discharge end of the first main stage housing, the discharge end of the second main stage housing providing communication between the second pre-mixing chamber and the main combustion zone.

15. The pre-mixing combustion chamber assembly of claim 14 further comprising a third main stage housing comprising an inlet end and a discharge end and defining a third pre-mixing chamber disposed therebetween, the discharge end of the third main stage housing providing communication between the third pre-mixing chamber and the main combustion zone, a fourth main stage housing comprising an inlet end and a discharge end and defining a fourth pre-mixing chamber disposed therebetween, the discharge end of the fourth main stage housing providing communication between the fourth pre-mixing chamber and the main combustion zone, and the discharge end of the third main stage housing being connected to a combustion chamber at a diametrically opposed position with respect to the discharge end of the fourth main stage housing, the discharge end of the third main stage housing being disposed between the discharge ends of the first and second main stage housings.

16. The pre-mixing combustion chamber assembly of claim 11 wherein the pilot stage is coaxial with respect to the combustion chamber.

17. The pre-mixing combustion chamber assembly of claim 11 wherein the pilot stage comprises a pilot combustion chamber and a pilot injection mechanism, the pilot combustion chamber being disposed between the pilot injection and the combustion chamber.

18. An annular combustion chamber assembly, comprising:

an annular combustion chamber comprising an inlet end connected to a plurality of pre-mixing combustion chamber assemblies spaced equidistantly around the inlet end of the annular combustion chamber, each pre-mixing combustion chamber comprising p2 a first main stage housing comprising an inlet end and a discharge end and defining a first pre-mixing chamber disposed therebetween, the discharge end of the first main stage housing being connected to a conical combustion chamber which is conically shaped and widens as the combustion chamber widens from a pilot end to an outlet end, the combustion chamber having a longitudinal axis and the first pre-mixing chamber having an outer surface whose longitudinal extent meets an outer surface of the conically-shaded combustion chamber substantially tangentially, the conical combustion chamber comprising a narrow pilot end and a wider outlet end, the conical combustion chamber defining a main combustion zone, the outlet end of the conical combustion chamber being connected to a housing section defining an after-combustion zone, the housing section being connected to the inlet end of the annular combustion chamber, the conical combustion chamber and housing section being disposed coaxially with respect to each other, the discharge end of the first main stage housing providing communication between the first pre-mixing chamber and the conical combustion chamber, and the pilot end of the conical combustion chamber being connected to a pilot stage comprising a pilot injection mechanism.

19. The annular combustion chamber assembly of claim 18 wherein each housing section is cylindrical.

* * * * *